United States Patent [19]

Mele

[11] 4,051,858

[45] Oct. 4, 1977

[54] SOLVENT SINK AND DISPENSER

[76] Inventor: Anthony P. Mele, 5316 E. Emile Zola, Scottsdale, Ariz. 85254

[21] Appl. No.: 754,505

[22] Filed: Dec. 27, 1976

[51] Int. Cl.[2] ..... B08B 3/02

[52] U.S. Cl. ..... 134/56 R; 134/95; 134/111; 134/115 R; 134/200; 49/1; 312/291

[58] Field of Search ..... 134/56 R, 95, 111, 115 R, 134/200; 49/1, 5; 312/291

[56] References Cited

U.S. PATENT DOCUMENTS

| | | | |
|---|---|---|---|
| 2,405,147 | 8/1946 | Kauffman | 134/115 R |
| 2,440,619 | 4/1948 | St. Laurence | 134/200 X |
| 3,378,019 | 4/1968 | Riolo et al. | 134/111 |
| 3,903,909 | 9/1975 | Noren et al. | 134/95 X |
| 3,921,653 | 11/1975 | Ducharme | 134/200 X |

*Primary Examiner*—Robert L. Bleutge
*Attorney, Agent, or Firm*—Warren F. B. Lindsley

[57] ABSTRACT

A two-compartment sink for the cleaning of automotive parts with solvents, provision being made for selectively drawing solvent fluid from either of two storage tanks and for selectively dispensing same through either or both of two dispensing heads including a nozzle on a flex hose and a feed-through brush. Protection is afforded against fire originating in the cleaning sink.

7 Claims, 6 Drawing Figures

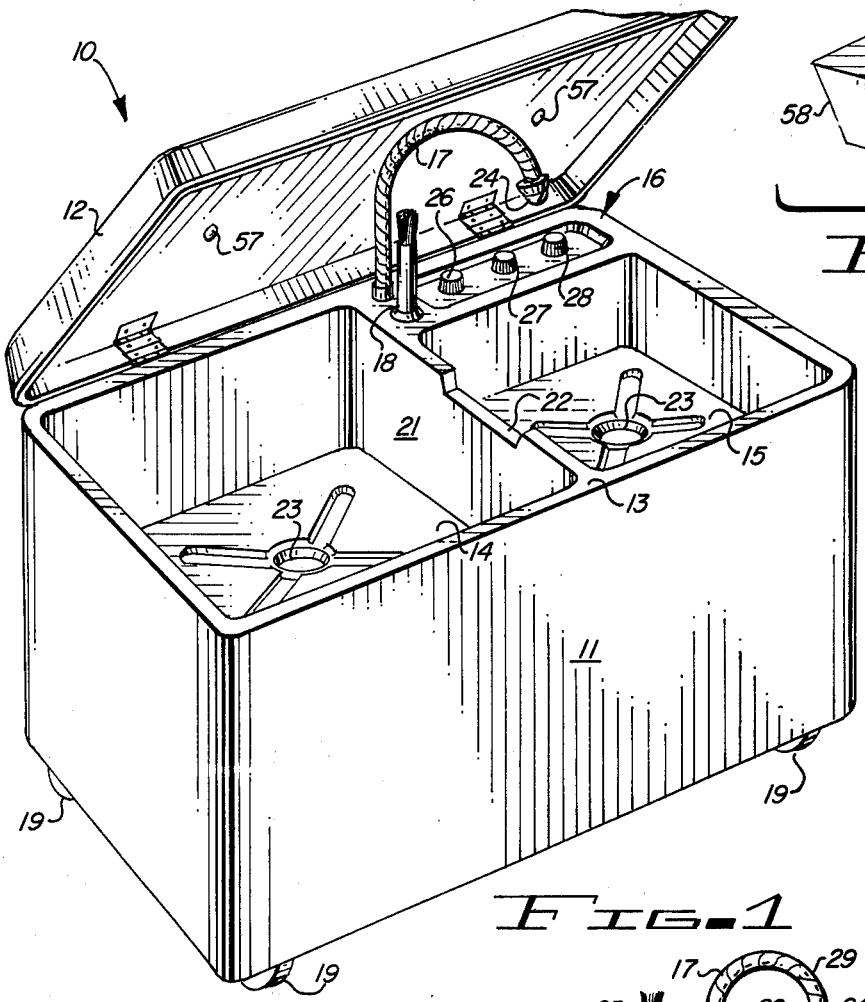
FIG. 1
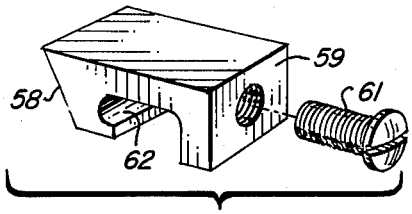
FIG. 6
FIG. 4
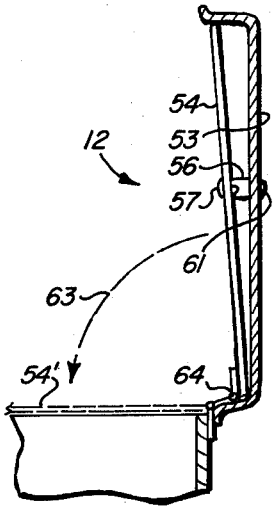
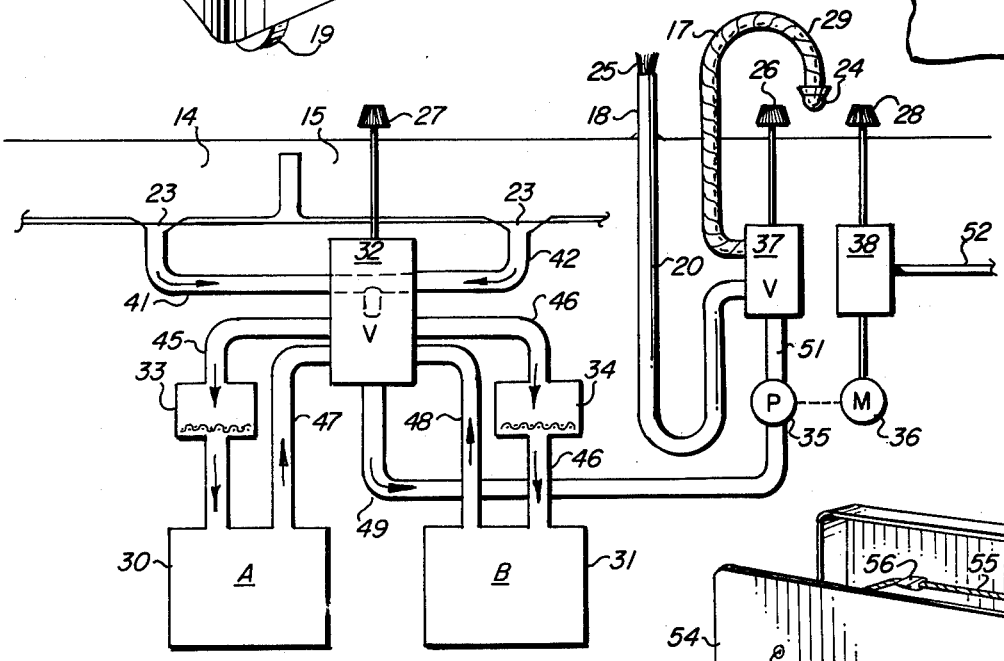
FIG. 2
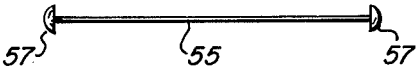
FIG. 5
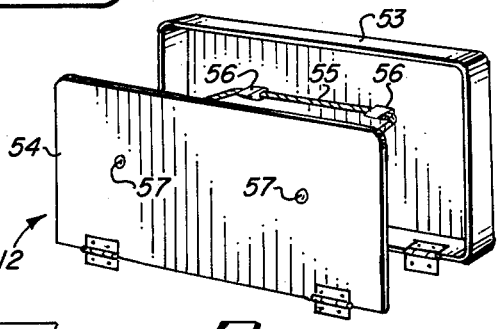
FIG. 3

SOLVENT SINK AND DISPENSER

BACKGROUND OF THE INVENTION

In the modern automotive service station there is a continuous need for a convenient and effective cleaning station where used parts removed from an automobile or other vehicle may be cleaned of grease and grime prior to inspection, repair or replacement. These automotive parts commonly include, for example, components of carburetors, fuel pumps, transmissions, wheel and axle assemblies, and the like.

Such parts or components are highly precise and must be thoroughly cleaned and freshly lubricated to function properly after reassembly and installation in the vehicle. Furthermore, the cleaning must be done under controlled conditions and in a systematic manner which will minimize the loss of the smaller parts.

For such purposes the crude pan or tube into which solvent is poured as needed and replaced in a haphazard manner is totally inadequate. This outmoded practice typically results in improperly cleaned parts in contaminated solvents and leaves the work station in an unsightly condition. There is also the ever-present hazard of fire because of the flammable nature of the solvents used for such cleaning operations.

In response to this need for a better cleaning facility, various types of cleaning sinks have been offered in varying degrees of complexity. Such improved cleaning sinks have offered features including a reserve supply of cleaning fluid, convenient solvent replacement means, filters for cleaning the solvent, pumps for handling the solvents, working lights and the like. In all such units the important considerations are economy, serviceability and convenience.

While these improved cleaning sinks constitute a great improvement over the simple tub or pan there are still a number of shortcomings calling for attention. Such improved cleaning stations are typically accessible or useable by only one mechanic at a time. There is no provision for instantaneously switching to a clean supply of solvent or to a solvent of a different type as the need arises. Inadequate provisions are made against damage to the equipment in the event a distracted mechanic leaves the pump running while attending to other duties. Furthermore, such cleaning stations are not adequately protected against fire which might originate in the cleaning tanks owing to the presence of the flammable solvents used for cleaning.

SUMMARY OF THE INVENTION

In accordance with the invention claimed, an improved cleaning station is provided for cleaning automotive parts, the station being useable by two people simultaneously and providing means for selection of either of two solvent supplies as well as either of two dispensing heads. Protection is afforded against damage due to negligence and against fire originating in the sink area.

It is, therefore, one object of this invention to provide an improved solvent sink and dispenser for use as an automotive parts cleaning station.

Another object of this invention is to provide in such a sink and dispenser a capability for simultaneous use by two people.

A further object of this invention is to facilitate such simultaneous use through the incorporation of two separate sink compartments and by the provision of two solvent dispensing heads.

A still further object of this invention is to provide a convenient means for enabling either or both of the two dispensing heads for individual or simultaneous use.

A still further object of this invention is to provide a measure of versatility in terms of the dispensing heads wherein the one head is in the form of a nozzle at the end of a flexible hose and the other is in the form of a feed-through brush.

A still further object of this invention is to provide improved control and options relative to the solvent material employed in the sink and dispenser.

A still further object of this invention is to provide instant access to either of two solvent tanks located in the base of the sink and dispenser cabinet, wherein one tank may contain fresh solvent and the other tank may contain solvent that is at least partially contaminated due to use or it may contain a solvent of a different type.

A still further object of this invention is to provide integrally with the solvent selection means a simultaneously controlled means which causes the same solvent to be returned after use to the solvent tank from which it was drawn.

A still further object of this invention is to provide for the filtering of the solvent material before it is returned to the solvent storage tank.

A still further object of this invention is to provide protection in the event of overflow from either of the two sinks which may result when the user is distracted while the sink is being filled, such protection to be afforded through overflow into the other sink and return through the drain to the solvent storage tank.

A still further object of this invention is to provide protection against damage to the solvent pump which might otherwise occur as the result of such overflow.

Yet another object of this invention is to provide protection against fire which might originate in the sink area involving the flammable solvent material.

Further objects and advantages of the invention will become apparent as the following description proceeds and the features of novelty which characterized this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of the improved solvent sink and dispenser unit of the invention;

FIG. 2 is a functional diagram illustrating the operation of the working parts of the sink and dispenser of FIG. 1;

FIG. 3 is an exploded view of the lid or cover assembly which incorporates protective means against fire;

FIG. 4 is a side view of the lid or cover assembly shown in the raised position;

FIG. 5 shows a flexible cord employed in the support of a fire-protection plate incorporated in the lid or cover assembly of FIGS. 3 and 4; and FIG. 6 is a perspective view of a cord retainer block employed to support the cord of FIG. 5 in the lid or cover assembly of FIGS. 3 and 4.

DESCRIPTION OF THE PREFERRED EMBODIMENT

Referring more particularly to the drawing by characters of reference, FIGS. 1–6 disclose the improved solvent sink and dispenser unit 10 of the invention, the unit 10 comprising cabinet 11, a lid or cover assembly 12, a two-compartment sink 13 including a large sink compartment 14, a smaller sink compartment 15 and a control panel 16, and first and second solvent-dispensing heads 17 and 18, respectively.

The cabinet 11 is rectangular, having a length approximately twice its width and a height of approximately 38 inches. Its outward appearance resembles a large mechanic's tool chest and it is similarly mounted on four industrial swivel casters 19. The sink 13 conforms to the outlines of the cabinet 11 and is supported in the top portion as shown in FIG. 1. The lower portion of the cabinet 11 houses the plumbing, controls, solvent storage tanks etc., and the lid or cover 12 is hinge-connected to its top rear edge.

The two-compartment sink 13 has its large sink compartment 14 occupying slightly more than half its total area on the lefthand side. The remaining area on the right is divided between the smaller sink compartment 15 and a narrow strip across the rear occupied by the control panel 16. A wall 21 separates the large sink compartment 14 from the small sink compartment 15. A cut-out 22 which may, for example, be positioned in the center of the top edge of the wall 21 permits solvent overflow from either of the tanks 14 or 15 to flow into the other so that if solvent is left running into either sink and inadvertently left to overflow, the overflow will pass into the other sink to be returned to the solvent storage tank. In this way solvent spillage is prevented and the solvent supply is prevented from being depleted to the point that the pump runs dry and destroys itself. Each of the sink compartments 14 and 15 has a center drain opening 23 which provides a return for the solvent material to the solvent storage tanks.

The two dispensing heads 17 and 18 extend upwardly through two openings in the top surface of sink 13 located at the lefthand edge of control panel 16. The first head 17 has a nozzle-type dispenser 24 mounted on the end of a flexible metal hose 29 which will remain in any set position over either sink compartment 14 or 15. The second head 18 has a feed-through brush 25 mounted at the end of a flexible rubber or synthetic hose 20. In this case, the solvent material is ejected through the center of the bristles. The stiff bristles are useful in breaking loose dirt and grime from crevices in sharply contoured parts and the simultaneous solvent flow aids greatly in the cleaning process.

Control panel 16 provides three control knobs 26, 27 and 28 disposed from left to right. The left-most knob 26 controls solvent flow to the heads 17 and 18. Knob 26 has three positions, one of which directs flow to head 17, another to head 18, and the third to both heads 17 and 18 simultaneously. The center control knob 27 has two positions "A" and "B". When knob 27 is in the "A" position it sets a valve which causes solvent to be drawn from and returned to a first tank (tank A) located in the base of cabinet 11. Turning knob 27 to position "B" selects the second solvent tank (tank B) in the base of cabinet 11. The right-hand knob 28 operates the on/off switch or pneumatic control for the electric or pneumatic drive motor which operates the solvent pump, also located in the base of cabinet 11.

The internal parts of unit 11 as represented in their functional arrangement are shown in FIG. 2 to include the two solvent storage tanks 30 and 31 (i.e. tanks A and B), respectively), a two-way valve 32 which selects tank 30 or 31, in-line solvent filters 33 and 34, pump 35 and associated drive motor 36, a three-way valve 37 which selects either or both of the drive heads 17 and 18, and on/off switch or pneumatic motor control 38. The control knobs 26, 27 and 28 are coupled as shown to three-way valve 37, two-way valve 32 and switch 38, respectively.

In the arrangement of these parts, as shown in FIG. 2, drain openings 23 of sink compartments 14 and 15 are connected by pipes 41 and 42, respectively to a common inlet port on valve 32. Corresponding outlet ports lead through pipes 45 and 46 and through respective in-line filters 33 and 34 to tanks 30 and 31. From tanks 30 and 31, fluid delivery lines 47 and 48, respectively, lead to seaprate inlet ports on valve 32 for selective discharge through a common exhaust line 49 which leads to the intake side of pump 35. The exhaust port of pump 35 is connected by a line 51 to the intake of three-way valve 37 which, in turn, directs solvent flow to either or both of heads 17 and 18.

In the operation of unit 10, the operator first sets control knob 26 to select either head 17 or 18 and then activates motor 36 by means of knob 28. He may utilize either of the two sink compartments 14 and 15 as appropriate. If a second operator wishes to use unit 10 at the same time, he takes the unoccupied sink compartment and turns knob 26 to the position which causes solvent to be delivered to both heads 17 and 18. In this way he can begin and conduct his cleaning task without disturbing the first operator. If the first operator completes his task first, he moves knob 26 to the position which selects the head 17 or 18 being used by the other operator before he leaves the unit.

If it is assumed that the first operator has selected head 17 and compartment 14 and that knob 27 and valve 32 are set to select tank 30 (i.e. tank A), solvent flow is from tank 30 through line 47 to valve 32, from valve 32 through line 49 to pump 35, from pump 35 through line 51 to valve 37 and head 17. The solvent discharged into sink compartment 14 flows through opening 23 and pipe 41 to valve 32 and thence through pipe 45 and filter 33 back to tank 30. The heavier dirt particles from the returned solvent are retained in filter 33 for periodic removal.

Similarly, if tank 31, head 18 and compartment 15 are selected or utilized, solvent flow is from tank 31 through line 48, valve 32, line 49, pump 35, line 51, valve 37 and head 18 to compartment 15. From compartment 15 the solvent returns to tank 31 via opening 23, pipe 42, valve 32, pipe 46 and filter 34.

Motor 36 is preferably a pneumatic type which may be air driven from a compressed air line 52 which is readily available at any automotive service station. In this case control 38 is simply a valve which is opened or closed to activate or deactivate motor 36. Alternatively an electric motor 36 may be employed, in which case control 38 becomes an electric on/off switch controlling voltage from a utility supply line 52.

The lid or cover assembly 12, as shown most clearly in FIGS. 3 and 4, comprises a pan-shaped outer shell 53 and an inner fire plate 54 separately hinged at their bottom edges to the upper rearward edge of cabinet 11. The fire-plate 54 is a flat rectangular metal plate appropriately dimensioned to permit its storage during normal use inside shell 53 as shown in FIG. 4. In this stored position the upper end of plate 54 is drawn into shell 53 by means of a pair of cord retainers 56 and the ends of which pass through holes in plate 54 to be engaged by two fusible retainer buttons 57. The retainers 56 are positioned along a horizontal line located somewhat above the horizontal center line of shell 53 and the holes in plate 54 are approximately aligned therewith.

In the normal position of cover 53 during use of unit 10, the outer surface of shell 53 is approximately upright or vertical as shown in FIG. 4 while plate 54 as stored inside shell 53 is inclined slightly to the left or toward the open sink 13. In this position, plate 54 is prevented from falling through the restraint of chain or metallic cord 55 which has its main body attached to shell 53 with the aid of the two retainers 56 and its ends attached to plate 54 by means of buttons 57.

The retainer 56, as shown most clearly in FIG. 6, is fashioned from a generally rectangular block of metal which is tapered at one end 58 for conformance to the surface of the inclined plate 54 and is drilled and tapped at the other end 59 for attachment by means of a screw 61 to shell 53. Into the underside of retainer 56 an open hook 62 is formed which holds the flexible cord 55 so long as cord 55 is under tension, but releases cord 55 if tension is lost.

It will now be apparent that if either of the buttons 57 should melt and fall away as in the event of a fire directly thereunder in compartment 14 or 15, the associated end of cord 55 will be drawn free of plate 57, tension will be lost in cord 55 and it will drop free of the retainers 56, permitting plate 54 to fall down to the broken line position 54', as shown in FIG. 4, bending the drive heads 17 and 18 to cover and smother the fire before it has a chance to spread to the surrounding building or equipment. The broken line arrow 63 in FIG. 4 indicated the fall of plate 54 about its hinged connection 64 at its lower edge.

FIG. 5 shows in somewhat greater detail cord 55 as attached to the fusible buttons 57. The buttons 57 are attached to the ends of cord 55 after the ends are passed through the holes in plate 54. The buttons are made of metal with a low melting temperature or of a plastic material which melts or burns readily.

A simple, effective and economical fire protection means is thus embodied in the cover assembly 12 as just described. This and the other stated objects of the invention are thus demonstrably provided as features of the improved solvent sink and dispenser unit 10.

Although but a single embodiment of the invention has been illustrated and described, it will be apparent to those skilled in the art that various changes and modifications may be made therein without departing from the spirit of the invention or from the scope of the appended claims.

What is claimed is:

1. A solvent sink and dispenser comprising in combination:

a cabinet comprising an open top having a cover hingedly mounted along one of its top edges, a two compartment sink mounted in a recessed manner within the top of said cabinet, each of the compartments having a drain in the bottom thereof, a pair of fluid tanks mounted within said cabinet, a pair of fluid dispensing heads mounted in said cabinet for dispensing fluid into either compartment of said sink, a conduit system including a first valve means for selectively connecting in a closed system either of said tanks to said dispensing heads from said heads into one or more of the compartments of said sink through its drain and back to a selected tank, means for pressurizing said system, a second valve means connected in said system for selectively connecting said conduit system to a given one of said dispensing heads, a fire resistant plate hingedly mounted on said cover for movement to and from said cover, and temperature sensitive means interconnecting said cover and said plate for releasing said plate for its movement away from said cover and over said sink when said cover is in an open position upon a fire occurring in said sink and effecting in a predetermined manner said temperature sensitive means.

2. The solvent sink and dispenser set forth in claim 1 wherein:

said plate is hingedly mounted within the outline of said cover.

3. The solvent sink and dispenser set forth in claim 1 wherein:

said temperature sensitive means comprises at least in part a meltable material.

4. The solvent sink and dispenser set forth in claim 1 wherein:

said temperature sensitive means comprises a cord having a heat sensitive end extending through said cover on the side of said cover facing one of the compartments of said sink.

5. The solvent sink and dispenser set forth in claim 1 wherein:

said temperature sensitive means comprises a cord slidably mounted on the inside surface of said cover, the ends of which are provided with temperature sensitive members, and each of said temperature sensitive members extending through said plate to a point above a different one of like compartments of said sink and holding said cover in a given position over said sink.

6. The solvent sink and dispenser set forth in claim 1 wherein:

said fluid comprises one or more different solvents.

7. The solvent sink and dispenser set forth in claim 1 wherein:

a partition separating the compartments of said sink are provided with an interconnecting overflow passageway.

* * * * *